US007588245B2

(12) United States Patent
Mandel et al.

(10) Patent No.: US 7,588,245 B2
(45) Date of Patent: Sep. 15, 2009

(54) FRICTION RETARD SHEET FEEDER

(75) Inventors: Barry P. Mandel, Fairport, NY (US); Robert Alan Clark, Williamson, NY (US)

(73) Assignee: Xerox Corporation, Norwalk, CT (US)

( * ) Notice: Subject to any disclaimer, the term of this patent is extended or adjusted under 35 U.S.C. 154(b) by 282 days.

(21) Appl. No.: 11/266,401

(22) Filed: Nov. 3, 2005

(65) Prior Publication Data

US 2007/0096385 A1 May 3, 2007

(51) Int. Cl.
*B65H 3/52* (2006.01)

(52) U.S. Cl. ..... 271/122; 271/125; 271/262; 271/265.04

(58) Field of Classification Search ..... 271/122, 271/125, 262, 263, 265.04
See application file for complete search history.

(56) References Cited

U.S. PATENT DOCUMENTS

| | | | | |
|---|---|---|---|---|
| 3,961,786 | A * | 6/1976 | Yanker | 271/122 |
| 4,203,586 | A * | 5/1980 | Hoyer | 271/34 |
| 4,368,881 | A | 1/1983 | Landa | |
| 4,940,224 | A * | 7/1990 | Couper | 271/263 |
| 5,016,866 | A * | 5/1991 | Takahashi | 271/122 |
| 5,039,080 | A | 8/1991 | Kato et al. | |
| 5,129,642 | A * | 7/1992 | Svyatsky et al. | 271/10.03 |
| 5,313,253 | A * | 5/1994 | Martin et al. | 399/16 |
| 5,335,043 | A * | 8/1994 | Kluger et al. | 399/16 |
| 5,435,538 | A | 7/1995 | Billings et al. | |
| 5,435,540 | A * | 7/1995 | Martin et al. | 271/122 |
| 5,622,363 | A * | 4/1997 | Beaudreau et al. | 271/110 |
| 5,887,866 | A * | 3/1999 | Yamauchi et al. | 271/116 |
| 6,234,470 | B1 * | 5/2001 | Okitsu et al. | 271/114 |
| 7,052,008 | B2 * | 5/2006 | Mitsuya et al. | 271/122 |
| 2004/0188919 | A1 * | 9/2004 | Sakamaki et al. | 271/122 |

* cited by examiner

*Primary Examiner*—Patrick H Mackey
*Assistant Examiner*—Luis Gonzalez
(74) *Attorney, Agent, or Firm*—Fay Sharpe LLP

(57) ABSTRACT

A retard feeder adapted to separate and advance media sheets comprising a media sheet advancing device including a drive roll and a retard roll. The drive roll and the retard roll include a feed nip therebetween for driving the media sheets at a velocity. A first drive system is provided to selectively drive the drive roll and the at least one nudger roll in a forward direction. A second drive system drives the retard roll through a slip clutch having a torque wherein the slip clutch torque allows the retard roll to rotate at substantially the same velocity as the drive roll when only one sheet is in the feed nip. The retard feeder further includes a motion sensor for detecting a signal when the retard roll stops rotating at the velocity of the drive roll corresponding to when more than one sheet is in the feed nip. The second drive system can selectively vary the velocity of the retard roll in response to the signal from the retard roll motion sensor.

6 Claims, 3 Drawing Sheets

FRICTION RETARD SHEET FEEDER

BACKGROUND

This disclosure relates generally to a sheet feeder, and more particularly concerns sheet feeder having a reversing retard roll utilizing an integral torque limiting slip clutch having a reversing bias.

In a typical electrophotographic printing process, a photoconductive member is charged to a substantially uniform potential so as to sensitize the surface thereof. The charged portion of the photoconductive member is exposed to a light to selectively dissipate the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

In a commercial printing machine of the foregoing type, a sheet misfeed or multi-fed sheets can seriously impair the operation of the machine. It is advantageous in many of today's machines to provide for the in seriatim feeding of sheets from the top of the stack. Many devices have been developed to attempt to alleviate problems associated with feeding sheets and prevent multi-fed sheets. The present disclosure improves over past systems by providing a simple integral device to separate multi-feeds quickly and effectively.

CROSS REFERENCE TO RELATED PATENTS AND APPLICATIONS

The following disclosures may be relevant to various aspects of the present disclosure: U.S. Pat. No. 5,039,080 to Kato et al.; U.S. Pat. No. 4,368,881 to Landa; U.S. Pat. No. 4,203,586 to Hoyer; and U.S. Pat. No. 5,435,538 to Billings, et al.

Portions of the foregoing disclosures may be briefly summarized as follows. U.S. Pat. No. 5,039,080 describes a sheet feeding apparatus having a feed roller and a separating roller forming a nip utilizing a rotation resisting torque limiter and a spring to resiliently urge the separating roller in the reverse direction when a double fed sheet is in the nip. U.S. Pat. No. 4,368,881 discloses a top feed friction retard feeder that utilizes a spring loaded retard roll and a torque limiter to bias the reverse rotation at a predetermined torque level. U.S. Pat. No. 4,203,586 describes a multi-feed detection system including a drag roll in contact with a feed belt wherein a slip clutch applies a torque to the drag roll. A double fed sheet causes the drag roll to hesitate which is then detected by a sensor to activate a shut down as a result of the double fed sheet.

Active friction retard feeding is the most common feeding technology used in copiers/printers in the 20-100 pages per million (ppm) range. The primary drawback to active friction retard systems is the limited life of the roller materials and the slip clutch. These must be replaced every 200,000 to 500,000 sheets which increases the parts and labor/service costs of the machine. The roller life can be improved by using larger diameter rolls and newly developed elastomer materials, however, the life of the slip clutch can still be a limiting factor. It is desirable to increase the life of the slip clutch thereby reducing the frequency of replacing said clutch, to be described in more detail hereinafter.

SUMMARY

Aspects of the present disclosure in embodiments thereof include a retard feeder adapted to separate and advance media sheets comprising a media sheet advancing device including a drive roll and a retard roll. The drive roll and the retard roll include a feed nip therebetween for driving the media sheets at a velocity. A first drive system is provided to selectively drive the drive roll in a forward direction. A second drive system drives the retard roll through a slip clutch having a torque wherein the slip clutch torque allows the retard roll to rotate at substantially the same velocity as the drive roll when only one sheet is in the feed nip. The retard feeder further includes a motion sensor for detecting when the retard roll stops rotating at the velocity of the drive roll corresponding to when more than one sheet is in the nip feed. The second drive system can selectively vary the velocity of the retard roll when the more than one sheet is in the feed nip.

Pursuant to other aspects of the disclosure, there is provided an apparatus adapted to separate and advance media sheets comprising a media sheet advancing device including a drive roll and a retard roll wherein the drive roll and the retard roll include a feed nip therebetween for driving the media sheets at a velocity. A first drive system is provided to selectively drive the drive roll in a forward direction. A second drive system drives the retard roll through a slip clutch having a torque wherein the slip clutch torque allows the retard roll to rotate at substantially the same velocity as the drive roll. A motion sensor is provided for detecting when the retard roll stops rotating at the velocity of the drive roll. Further, a control system is provided for changing the velocity of the second drive system when the sensor detects that the retard roll has stopped turning at substantially the same velocity as the drive roll.

Yet still in accordance with other aspects, there is provided an apparatus adapted to separate and advance media sheets comprising a media sheet advancing device including a drive roll and a retard roll. The drive roll and the retard roll include a feed nip therebetween for driving the media sheets at a velocity. A first drive system is provided to selectively drive the drive roll in a forward direction. A second drive system drives the retard roll through a slip clutch having a torque wherein the slip clutch torque allows the retard roll to rotate at substantially the same velocity as the drive roll. A motion sensor is provided for detecting when the retard roll stops rotating at the velocity of the drive roll.

DETAILED DESCRIPTION

Figure 1:
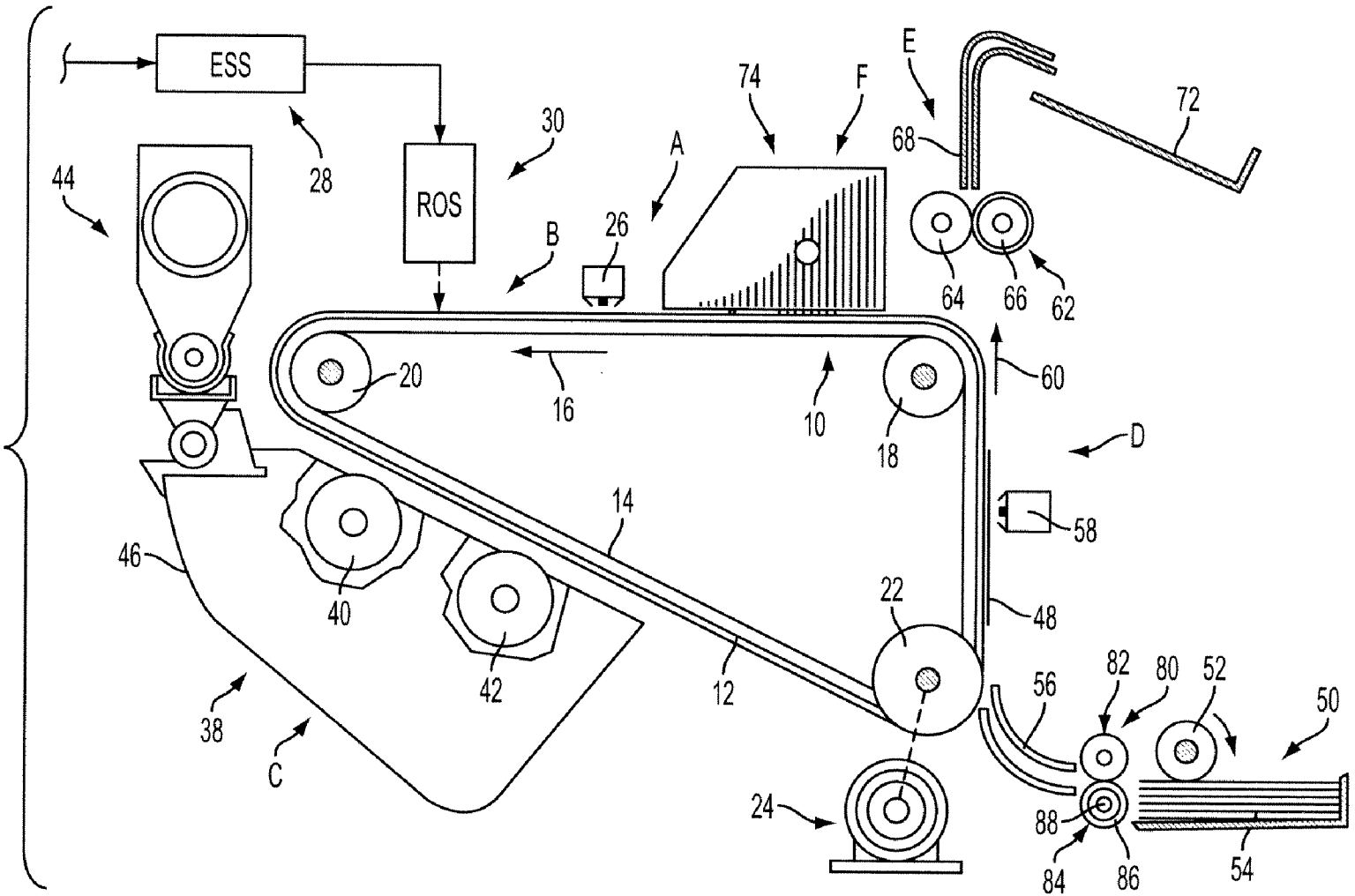
FIG. 1 PRIOR ART
FIG. 1 is a schematic elevational view of an exemplary electrophotographic printing machine including a retard roll feeder.

For a general understanding of the features of the present disclosure, reference is made to the drawings. In the drawings, like reference numerals have been used throughout to identify identical elements. FIG. 1 schematically depicts an exemplary electrophotographic printing machine. It will become evident from the following discussion that the sheet feeding apparatus of the present disclosure may be employed in a wide variety of devices and is not specifically limited in its application to the particular embodiment depicted herein.

FIG. 1 schematically illustrates an electrophotographic printing machine which generally employs a belt 10 having a photoconductive surface 12 deposited on a conductive ground layer 14. Preferably, photoconductive surface 12 is made from a photoresponsive material, for example, one comprising a charge generation layer and a transport layer. Conductive layer 14 can be made preferably from a thin metal layer or metallized polymer film which is electrically grounded. Belt 10 moves in the direction of arrow 16 to advance successive portions of photoconductive surface 12 sequentially through the various processing stations disposed about the path of movement thereof. Belt 10 is entrained about stripping roller 18, tensioning roller 20 and drive roller 22. Drive roller 22 is mounted rotatably in engagement with belt 10. Motor 24 rotates roller 22 to advance belt 10 in the direction of arrow 16. Roller 22 is coupled to motor 24 by suitable means, such as a drive belt. Belt 10 is maintained in tension by a pair of springs (not shown) resiliently urging tensioning roller 20 against belt 10 with the desired spring force. Stripping roller 18 and tensioning roller 20 are mounted to rotate freely.

Initially, a portion of belt 10 passes through charging station A. At charging station A, a corona generating device, indicated generally by the reference numeral 26 charges the photoconductive surface 12 to a relatively high, substantially uniform potential. After photoconductive surface 12 of belt 10 is charged, the charged portion thereof is advanced through exposure station B.

At exposure station B, a controller or electronic subsystem (ESS), indicated generally by reference numeral 28, receives the image signals representing the desired output image and processes these signals to convert them to a continuous tone or greyscale rendition of the image which is transmitted to a modulated output generator, for example the raster output scanner (ROS), indicated generally by reference numeral 30. Preferably, ESS 28 is a self-contained, dedicated minicomputer. The image signals transmitted to ESS 28 may originate from a computer, thereby enabling the electrophotographic printing machine to serve as a remotely located printer for one or more computers. Alternatively, the printer may serve as a dedicated printer for a high-speed computer. The signals from ESS 28, corresponding to the continuous tone image desired to be reproduced by the printing machine, are transmitted to ROS 30. ROS 30 can include a laser with rotating polygon mirror blocks. The ROS can illuminate the charged portion of photoconductive belt 20 at a resolution of about 300 or more pixels per inch. The ROS will expose the photoconductive belt to record an electrostatic latent image thereon corresponding to the continuous tone image received from ESS 28. As an alternative, ROS 30 may employ a linear array of light emitting diodes (LEDs) arranged to illuminate the charged portion of photoconductive belt 20 on a raster-by-raster basis.

In another embodiment, ESS 28 may be connected to a raster input scanner (RIS). The RIS has an original document positioned thereat. The RIS can include document illumination lamps, optics, a scanning drive, and photosensing elements, such as an array of charge coupled devices (CCD). The RIS captures the entire image from the original document and converts it to a series of raster scanlines which are transmitted as electrical signals to ESS 28. ESS 28 processes the signals received from the RIS and converts them to greyscale image intensity signals which are then transmitted to ROS 30. ROS 30 exposes the charged portion of the photoconductive belt to record an electrostatic latent image thereon corresponding to the greyscale image signals received from ESS 28.

After the electrostatic latent image has been recorded on photoconductive surface 12, belt 10 advances the latent image to a development station C, where toner, in the form of liquid or dry particles, is electrostatically attracted to the latent image using commonly known techniques. At development station C, a magnetic brush development system, indicated by reference numeral 38, advances developer material into contact with the latent image. Magnetic brush development system 38 includes two magnetic brush developer rollers 40 and 42. Rollers 40 and 42 advance developer material into contact with the latent image. These developer rollers form a brush of carrier granules and toner particles extending outwardly therefrom. The latent image attracts toner particles from the carrier granules forming a toner powder image thereon. As successive electrostatic latent images are developed, toner particles are depleted from the developer material. A toner particle dispenser, indicated generally by the reference numeral 44, dispenses toner particles into developer housing 46 of developer unit 38.

With continued reference to FIG. 1, after the electrostatic latent image is developed, the toner powder image present on belt 10 advances to transfer station D. A print sheet 48 is advanced to the transfer station D by a sheet feeding apparatus 50. The sheet feeding apparatus 50 can include a nudger roll 52 contacting the uppermost sheet of stack 54. Nudger roll 52 rotates to advance the uppermost sheet from stack 54 to a retard feeder assembly 80 which includes a drive roll or feed roll 82 and a retard roll 84 for forwarding sheets into chute 56. Chute 56 directs the advancing sheet of support material into contact with photoconductive surface 12 of belt 10 in a timed sequence so that the toner powder image formed thereon contacts the advancing sheet at transfer station D. Transfer station D includes a corona generating device 58 which sprays ions onto the back side of sheet 48. This attracts the toner powder image from photoconductive surface 12 to sheet 48. After transfer, sheet 48 continues to move in the direction of arrow 60 onto a conveyor (not shown) which advances sheet 48 to fusing station E. The fusing station E includes a fuser assembly, indicated generally by the reference numeral 62, which permanently affixes the transferred powder image to sheet 48. Fuser assembly 60 includes a heated fuser roller 64 and a back-up roller 66. Sheet 48 passes between fuser roller 64 and back-up roller 66 with the toner powder image contacting fuser roller 64. In this manner, the toner powder image is permanently affixed to sheet 48. After fusing, sheet 48 advances through chute 68 to catch tray 72 for subsequent removal from the printing machine by the operator. After the print sheet is separated from photoconductive surface 12 of belt 10, the residual toner/developer and paper fiber particles adhering to photoconductive surface 12 are removed therefrom at cleaning station F. Cleaning station F includes a rotatably mounted fibrous brush in contact with photoconductive surface 12 to disturb and remove paper fibers and a cleaning blade to remove the nontransferred toner particles. The blade may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the features of the present disclosure therein.

The description hereinafter proposes a method of increasing the life of a slip clutch by significantly reducing the number of slip revolutions the slip clutch sees during normal operation. This can be done by leaving a retard roll drive shaft 88 either stationary or turning at a slow velocity during normal feeder operation. It is to be appreciated that instead of a dedicated step motor or servo motor being applied to the retard drive 86, a simple clutch or other temporary drive engagement system (not illustrated) tied into the main drives could also be used. Examples include multiple engaging and disengaging gear sets for altering speed and direction of the retard roll relative to the feed roll.

Figure 2:
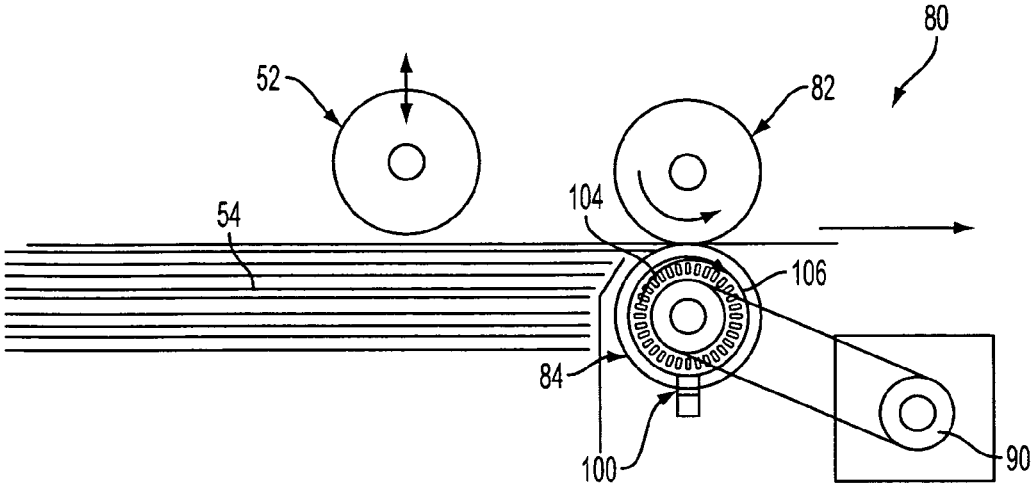
FIG. 2 is an elevational view of a friction retard feeder device in a first position according to the present disclosure.
Figure 3:
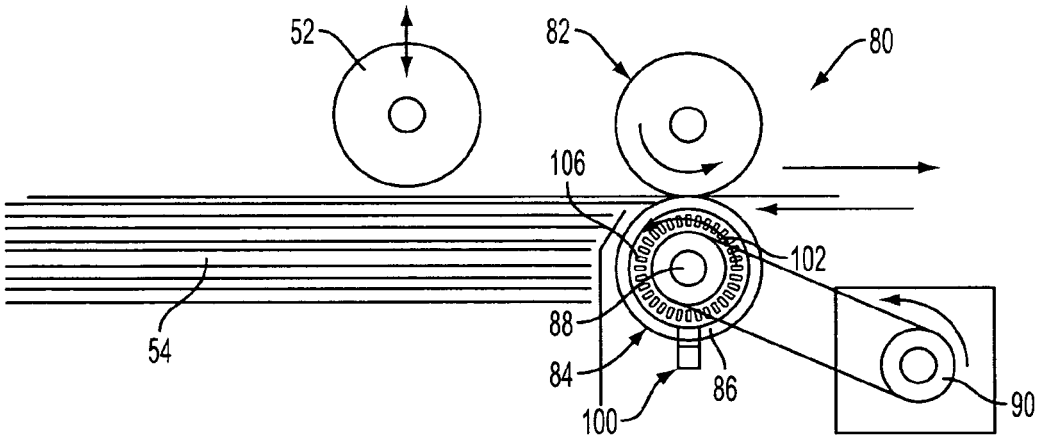
FIG. 3 is an elevational view of the friction retard feeder device second position; and, FIG. 4 is a flowchart displaying a control approach for the retard feeder device.

Turning now to FIGS. 2 and 3, the details of the retard roll assembly generally referred to by reference 80 with an integral reverse biasing device will be discussed. The retard roll 84 is formed from a cylindrical section 86 supported for rotation on a fixed shaft 88. The cylindrical portion 86 can be coated with an elastomeric surface such as silicone rubber which provides good frictional contact with the sheets being fed and is impervious to commonly used silicone release agents. Although not illustrated, the retard roll can have an integral slip clutch that acts between the shaft and drive roll. A wear ring can be fixed to one end of the roll portion 86. A wrapped spring can be fixed at one end to a disk so that the end of the spring remains fixedly attached to the shaft 88. As the retard roll assembly 80 rotates by frictional contact with a single sheet being driven by the feed roll 82, the spring can be unwound from the outer diameter of the wear ring. Once a predetermined torque is reached, the inner diameter of the spring can slip relative to the wear ring, allowing the retard roll 84 to overrun in the feed direction. Once again, if a double sheet enters the nip, the torque imparted to the retard roll 84 is less than that stored by the spring and the spring winds and through frictional contact with roll wear ring which is attached to roll portion 86, the retard roll 84 can be caused to reverse direction and again feed the double sheets back toward the feed tray. This embodiment could also be utilized with a tapered spring and a conical wear ring attached to the retard roll. It should be appreciated that a limited torque slip-clutch type mechanism could be used to provide the retard roll function described above.

An encoder 100, i.e., motion sensor, can be mounted to the retard roll 84 to monitor the motion of the retard roll 84. If the encoder 100 detects that the retard roll 84 has stopped rotating (indicating that more than one sheet has entered the feed nip), the retard drive shaft 88 is driven backward 102 via step motor 90 to reverse shingle the sheets and prevent a multi-feed. Since the retard roller 84 is not rotating in a reverse direction (i.e. 104) except when a slug (plurality of sheets) is being reversed shingled back into the tray, the life of the slip clutch 106 can be extended significantly. Variations of the above operation are possible in which the retard shaft 88 can be rotated slowly in the reverse 102 or forward 104 direction (instead of being stopped) until a slug is detected. This method and system also allows more latitude in selecting the reverse velocity of the retard shaft 88. In current active friction retard feeders, the reverse velocity of the drive shaft has a large affect on the life (number of slip revolutions) of the slip clutch 106. In the present system, the reverse drive velocity has a minimal affect on clutch life so a higher reverse drive velocity can be used (within other functional limits.) The size of the slug (number of sheets) that can be reversed shingled without causing a multi-feed is proportional to this reverse velocity.

Figure 4:
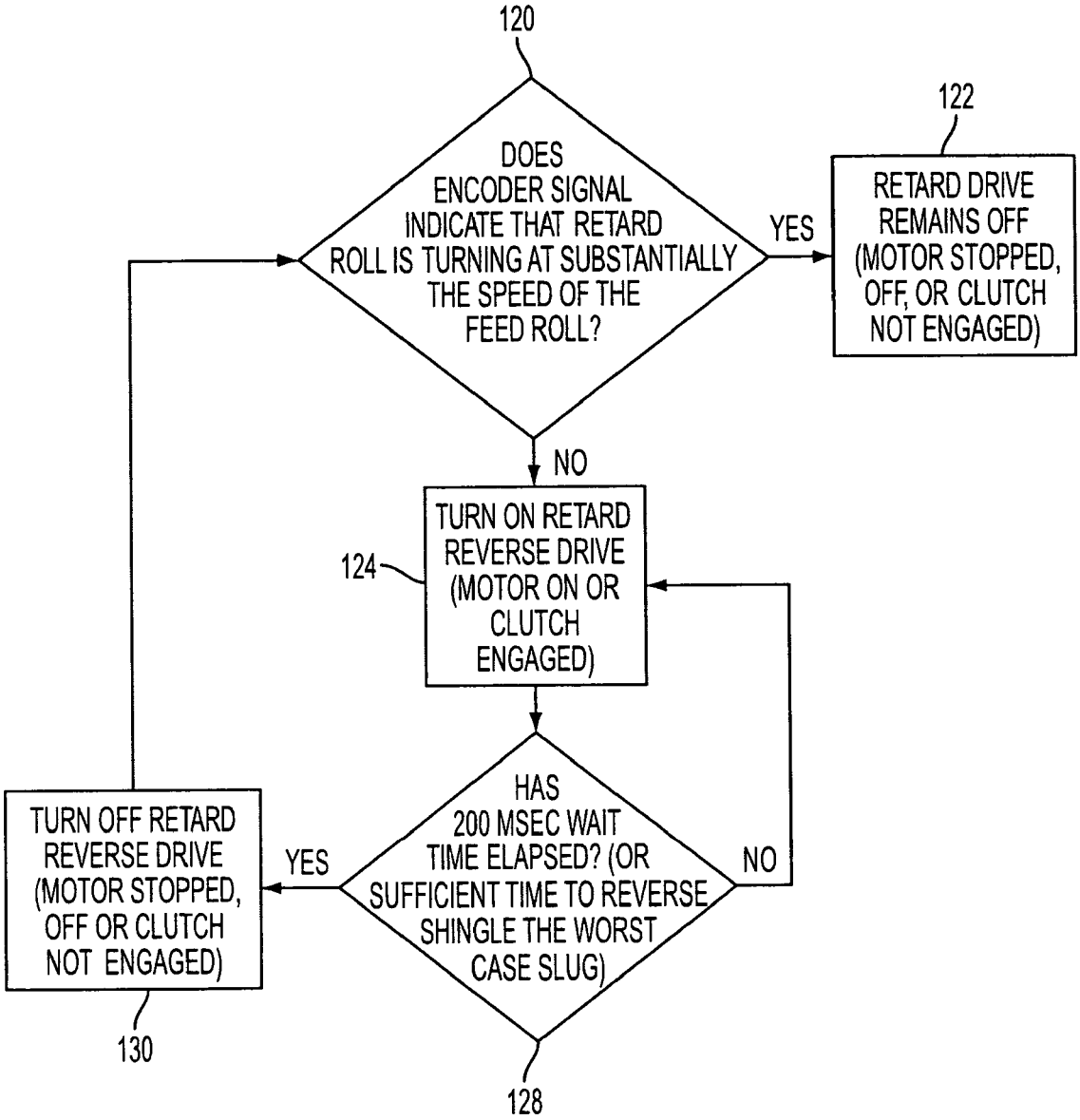

By way of example, a control approach for the retard drive described above is shown in the flowchart of FIG. 4. The encoder signal 120 indicates whether the retard roll 84 is turning at substantially the speed of the feed roll. If the retard roll 84 is turning, the retard drive remains off 122 (motor stopped (stationary) or reverse drive clutch not engaged). If the retard roll 84 is turning, then the retard reverse drive is turned on 124 (motor run in reverse direction or clutch engaged). It is to be appreciated that even greater slip clutch life improvements can be realized if the retard shaft 88 is driven in a forward direction 104 (at a speed less than the feed roll) until a slug is detected (by sensing a change in the retard roll speed). Other variations are also possible, for example, the control system changing the velocity of the retard drive system from a first velocity to a second velocity. The first velocity can be substantially zero and the second velocity can be in a reverse direction 102. Alternatively, the first velocity can be in a forward direction 104 but slower than that of the feed roll, and the second velocity can be in a reverse direction 102. Also, alternatively, the first velocity can be in a reverse direction and the second velocity can be in a higher reverse direction 102.

After the retard reverse drive has been turned on, a wait period 128 is measured (the specific wait time dependent on the velocities used in the system) in which to provide sufficient time to reverse shingle the worst case slug. By way of example only, one such wait period can be about 200 milliseconds. Once the sufficient period time has elapsed, the retard reverse drive is turned off 130 (motor stopped or clutch disengaged). The above approach is repeated until the job has been completed. If a quadrature encoder is used, then the reverse drive can be left on until the retard roll stops turning in a reverse direction. This could minimize drive time and unnecessary slip clutch revolutions, but increase cost associated with a more expensive encoder.

The retard feeders described have been shown in use as copy sheet feeders but are equally well adapted for use in document handlers to feed original documents for imaging or in any other use in which sequential single sheet feeding is desired.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. An apparatus adapted to separate and advance media sheets from a stack of media sheets, comprising:

a media sheet advancing device including a drive roll and a retard roll wherein the drive roll and the retard roll include a feed nip therebetween for driving the media sheets from a stack of media sheets in a feed tray at a velocity;

a first drive system to selectively drive the drive roll at a first velocity in a forward direction;

a second drive system to maintain the retard roll at a second velocity through a slip clutch having a torque when only one sheet is in the feed nip;

a motion sensor for detecting when the retard roll stops rotating at the second velocity corresponding to when a plurality of sheets are in the feed nip;

the second drive system selectively varies the second velocity of the retard roll when the plurality of sheets are in the feed nip;

a control system varies the velocity of the retard drive system between the second velocity and a third velocity;

the second velocity is substantially zero;

the third velocity is in a reverse direction for sequentially feeding each bottommost sheet from the plurality of sheets back into the feed tray until only one sheet is in the feed nip; and, the control system returns the retard drive system from the third velocity to the second velocity after the more than one sheet is removed from the feed nip.

2. An apparatus adapted to separate and advance media sheets from a stack of media sheets, comprising:

a media sheet advancing device including a drive roll and a retard roll wherein the drive roll and the retard roll include a feed nip therebetween for driving the media sheets from a stack of media sheets in a feed tray at a velocity;

a first drive system to selectively drive the drive roll at a first velocity in a forward direction;

a second drive system to drive the retard roll at a second velocity through a slip clutch when only one sheet is in the feed nip;

a motion sensor for detecting when the retard roll stops rotating at the second velocity of the drive roll corresponding to when more than one sheet is in the feed nip;

the second drive system selectively varies the second velocity of the retard roll when the more than one sheet is in the feed nip;

a control system varies the velocity of the retard drive system from the second velocity to a third velocity when the more than one sheet is in the feed nip;

the second velocity and the third velocity are continuously in the same reverse direction for sequentially feeding each bottommost sheet from the more than one sheet back into the feed tray until only one sheet is in the feed nip;

the third velocity is greater than the second velocity; and, the control system returns the retard drive system from the third velocity to the second velocity after the more than one sheet is removed from the feed nip.

3. The apparatus according to claim 2, wherein the control system includes a step motor external to the retard roller for varying the velocity of the retard roller.

4. An apparatus adapted to separate and advance media sheets from a stack of media sheets, comprising:

a media sheet advancing device including a drive roll and a retard roll wherein the drive roll and the retard roll include a feed nip therebetween for driving the media sheets from a stack of media sheets in a feed tray at a velocity;

a first drive system to selectively drive the drive roll in a forward direction at a first velocity;

a second drive system having a second velocity drives the retard roll through a slip clutch having a torque;

a motion sensor for detecting when the retard roll stops rotating at the second velocity;

a control system for changing the second velocity of the second drive system to a third velocity when the sensor detects that the retard roll has stopped turning at the second velocity;

the second drive system selectively varies the velocity and direction of the retard roll from the second velocity to the third velocity when more than one sheet is in the feed nip for sequentially feeding each bottommost sheet from the more than one sheet back into the feed tray until only one sheet is in the feed nip; and, the first velocity and the third velocity are greater than the second velocity.

5. An apparatus adapted to separate and advance media sheets from a stack of media sheets, comprising:

a media sheet advancing device including a drive roll and a retard roll wherein the drive roll and the retard roll include a feed nip therebetween for driving the media sheets from a stack of media sheets in a feed tray at a velocity;

a first drive system to selectively drive the drive roll at a first forward velocity in a forward direction;

a second drive system having a continuous reverse velocity drives the retard roll through a slip clutch at a second velocity;

a motion sensor for detecting when the retard roll stops rotating at the second velocity; and, a control system for changing the continuous reverse velocity of the second drive system from the second reverse velocity to a third reverse velocity when the sensor detects that the retard roll has stopped turning at the second velocity for sequentially feeding each bottommost sheet from a plurality of sheets back into the feed tray until only one sheet is in the feed nip.

6. The apparatus according to claim 5, wherein the third reverse velocity is greater than the second reverse velocity.

* * * * *